US006736486B2

(12) United States Patent
Nakamura et al.

(10) Patent No.: US 6,736,486 B2
(45) Date of Patent: May 18, 2004

(54) RECORDING APPARATUS

(75) Inventors: Nobuyuki Nakamura, Nara (JP); Shigeo Miyamoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/387,526

(22) Filed: Mar. 14, 2003

(65) Prior Publication Data

US 2003/0214557 A1 Nov. 20, 2003

(30) Foreign Application Priority Data

Mar. 15, 2002 (JP) ..... 2002-072291
Nov. 21, 2002 (JP) ..... 2002-338176

(51) Int. Cl.[7] ..... B41J 2/175
(52) U.S. Cl. ..... 347/49; 347/50
(58) Field of Search ..... 347/49, 50, 84, 347/85, 86, 87

(56) References Cited

U.S. PATENT DOCUMENTS 5,392,063 A 2/1995 Rhoads
6,502,917 B1 * 1/2003 Shinada et al. ..... 347/19

FOREIGN PATENT DOCUMENTS

| | | |
|---|---|---|
| EP | 0 997 297 A1 | 5/2000 |
| JP | 9-174869 A | 7/1997 |
| WO | 01/54911 A1 | 8/2001 |

* cited by examiner

*Primary Examiner*—Huan Tran
(74) *Attorney, Agent, or Firm*—Birch, Stewart, Kolasch & Birch, LLP

(57) ABSTRACT

An object of the present invention is to provide a recording apparatus which enables an easy operation of attaching and detaching an ink cartridge and a stable conduction state between an electrical contact thereof and an electrical contact on the side of a carriage unit. The recording apparatus is provided with, in order to securely hold an ink cartridge on a carriage unit, a cover disposed on the carriage unit so as to be openable and closable and a spring-like member which causes an energizing force to act on the ink cartridge so that an electrical contact disposed on the ink cartridge is energized and kept in press-contact in a direction opposed to an electrical contact disposed on the carriage unit, and constructed so that, by closing the cover, the ink cartridge is securely held on the carriage unit and both the electrical contacts are conduction-connected.

6 Claims, 9 Drawing Sheets

RECORDING APPARATUS

BACKGROUND OF THE INVENTION

1. Field of the Invention

The present invention relates to a recording apparatus which records by spraying ink to a recording medium, more specifically, relates to a mounting structure of an ink cartridge or the like which is attachable to and detachable from a carriage unit.

2. Description of the Related Art

In a recording apparatus which prints out by ink, for example, as disclosed in U.S. Pat. No. 5,392,063, there is a need to securely hold an ink cartridge on a carriage unit in a state where electrical contacts thereof are kept in press-contact. FIGS. 1A to 1C and FIG. 2 are mounting corresponding views for mounting an attachable and detachable ink cartridge 1 on a carriage unit 2 of an inkjet printer (a recording apparatus), more specifically, views showing a state where an electrical contact 3 disposed on the ink cartridge 1 is conduction-connected to an electrical contact 4 disposed on the carriage unit 2. Furthermore specifically, FIG. 1A is a sectional view showing a state where the ink cartridge 1 is mounted on the carriage unit 2 of a prior art. FIG. 1B is a side view of the ink cartridge 1. FIG. 1C is an enlarged sectional view showing a section I of FIG. 1A. FIG. 2 is a sectional view showing the carriage unit 2 of the prior art in a state where a cover 7 is opened.

The ink cartridge 1 is provided with an ink nozzle part 1*a* which discharges ink to a recording medium, a flexible print board 1*b* which outputs, to the ink nozzle part 1*a*, a control signal for executing discharge control of ink discharged to a recording medium, and the electrical contact 3 for receiving the control signal to the flexible print board 1*b* from the electrical contact 4 of the carriage unit 2.

When this ink cartridge 1 is mounted on the carriage unit 2, the electrical contact 4 of the carriage unit 2 and the electrical contact 3 of the ink cartridge 1 are conduction-connected in a press-contact state. As a result, an electrical signal is obtained from the carriage unit 2 via the electrical contacts 3 and 4, and ink discharge control is executed. Therefore, a sufficient press-contact force is required to form a stable conduction state between the electrical contacts 3 and 4.

In an example of a conventional method, a protruding portion 1*c* having a slope face S is disposed on a top face of the ink cartridge 1, a pressing member 5 pressed by a coil spring 5*a* is disposed on the cover 7 (or a lever or the like) attached to the carriage unit 2 so as to be openable and closable, and when the cover 7 is closed after the ink cartridge 1 is mounted on the carriage unit 2, a slope face S of the pressing member 5 touches the slope face S of the protruding portion 1*c* in an energizing state. By applying a pressure on the slope face S of the protruding portion 1*c* by the touch of the slope face S of the pressing member 5 in a direction of a vector V (a direction to the contacts), that is, in a direction of the normal line perpendicular to the slope face S of the protruding portion 1*c*, the electrical contact 3 of the ink cartridge 1 is pressed and energized against the electrical contact 4 of the carriage unit 2. Here, a reference numeral 8 in FIGS. 1A and 2 denotes a guide rail for guiding the carriage unit 2 in a main scanning direction, and the guide rail is inserted so as to be slidable in a guide hole at a lower part of a main body of the carriage unit 2.

In this construction, in a case where, for example, a pressure of 50 g is required for a single contact and there are forty two contacts, a pressure of 2100 g is required in total as a contact pressure between the electrical contact 3 of the ink cartridge 1 and the electrical contact 4 of the carriage unit 2.

In the case of examining by setting this as a prerequisite and decomposing a force which acts on the ink cartridge 1 to an X-direction component force, a Y-direction component force and moment, the following expressions (1) to (3) hold.

$$X \text{ direction: } F2\cdot\sin 43.5^\circ - F1 - F3 = 0 \quad (1)$$

$$Y \text{ direction: } F4 + F5 - F2\cdot\cos 43.5^\circ = 0 \quad (2)$$

$$\text{Moment: } 20.1F1 + 42.7F4 - 17.1F2 = 0 \quad (3)$$

Here, a rotation center of the moment is denoted by MO in the drawings.

In the above expressions (1) to (3), in the case of calculating so that values of F1 to F5 become positive values, the minimum values of F1 to F5 are as follows: F1=2100 g, F2=3051 g, F3=0 g, F4=233 g, and F5=1980 g. However, in practice, it is desirable that F3 has a value of 0 or more, F2, F4 and F5 are required to have larger values than the above values.

Further, as shown in FIG. 2, a force of 2213 g of a component force in a direction perpendicular to the pressing member 5 (=F2·sin 46.5°) is necessary at the time of closing the cover 7 for holding the ink cartridge 1, and a large force is required for a user in order to mount the ink cartridge 1.

Although a comparatively low pressure is enough to hold the ink cartridge 1 on the carriage unit 2 fundamentally, as described above, in order to obtain sufficient electrical conduction between the electrical contacts 3 and 4 disposed on the carriage unit 2 and the ink cartridge 1, there is a need to cause a considerably strong press-contact force to act on both the contacts 3, 4.

Therefore, consequently, the pressing member 5 is required to exert a pressing force equal to or more than a force for holding the ink cartridge 1. Furthermore, since an acting direction of the pressing force from the pressing member 5 is slant against a joining direction of the electrical contacts 3 and 4, a pressing force equal to or more than a pressure necessary for electrical conduction is needed.

Accordingly, there is a problem that at the time of closing the cover 7 after mounting the ink cartridge 1 on the carriage unit 2, there is a large reaction force from the pressing member 5, it is hard to close because of a considerably strong resistance, and the operability is bad.

At the same time, since the carriage unit 2 needs a rigidity enough to resist such a pressure, it is necessary to use a material having a high rigidity, and since it is necessary to set a sufficient wall thickness, the weight increases and the cost rises.

Furthermore, since the number of the electrical contacts 3 and 4 for one ink cartridge 1 trends toward increase because the number of holes of an ink spraying nozzle increases as a resolution and a speed of a recording apparatus get higher, there is a need to exert a higher pressure on the ink cartridge 1, and the problem of decrease of the operability, increase of the weight of the carriage unit and rise of the cost gets more significant.

SUMMARY OF THE INVENTION

The present invention is made in consideration of these actual conditions, and an object thereof is to provide a recording apparatus which enables a simple attachment/detachment operation of an ink cartridge and a stable conduction state between an electrical contact thereof and an electrical contact of a carriage unit and prevents increase of the weight of the carriage unit and rise of the cost.

The invention provides a recording apparatus comprising a carriage unit having an electrical contact, an ink cartridge having an electrical contact, the ink cartridge being mounted so as to be attachable and detachable to the carriage unit in a state where the electrical contacts are kept in press-contact with each other, a cover for opening and closing an attachment/detachment direction of the ink cartridge in the carriage unit, energizing means for generating an energizing force responsive to a deformation amount in the opposite direction to a deformation direction, the energizing means being arranged in the carriage unfit so as to be opposed to a wall face on the opposite side to a wall face provided with the electrical contact of the ink cartridge mounted on the carriage unit, and an insertion member which is inserted in or removed from between the energizing means and the wall face on the opposite side to the wall face provided with the electrical contact of the ink cartridge in accordance with a movement of the cover in a closing direction or an opening direction, the insertion member being disposed on the cover so as to be movable in a press-contact direction of the electrical contact of the carriage unit and the electrical contact of the ink cartridge, wherein the insertion member deforms the energizing means in accordance with a movement of the insertion member in an insertion direction so as to gradually move away from the wall face on the opposite side to the wall face provided with the electrical contact of the ink cartridge in the opposite direction to the press-contact direction.

According to the invention, when the cover is closed after the ink cartridge is mounted on the carriage unit, the insertion member disposed on the cover is inserted in between the energizing means disposed on the carriage unit and the wall face on the opposite side to the wall face provided with the electrical contact of the ink cartridge, thereby deforming the energizing means so as to gradually move away from the wall face on the opposite side to the wall face provided with the electrical contact of the ink cartridge in the opposite direction to the press-contact direction of the electrical contact of the ink cartridge and the electrical contact of the carriage unit, and displacing in the press-contact direction of the electrical contact of the ink cartridge and the electrical contact of the carriage unit. Therefore, the energizing pressing generates an energizing force which gradually increases in the press-contact direction of the electrical contact of the ink cartridge and the electrical contact of the carriage unit in accordance with a movement of the cover in the closing direction, and this energizing force acts via the insertion member on the wall face on the opposite side to the wall face provided with the electrical contact of the ink cartridge, whereby the electrical contact of the carriage unit and the electrical contact of the ink cartridge are kept in press-contact. As a result, a reaction force which acts on the cover when the cover moves in the closing direction gradually increases in accordance with a displacement amount of the cover, and the operability at the time of closing the cover increases. Moreover, the electrical contact of the carriage unit and the electrical contact of the ink cartridge are kept in press-contact in a stable state by the energizing force acting in the press-contact direction thereof via the insertion member.

According to the invention, by causing the energizing means to generate the energizing force which gradually increases in the press-contact direction of the electrical contact of the ink cartridge and the electrical contact of the carriage unit in accordance with a movement of the cover in the closing direction, causing this energizing force to act via the insertion member on the wall face on the opposite side to the wall face provided with the electrical contact of the ink cartridge, and keeping the electrical contact of the carriage unit and the electrical contact of the ink cartridge in press-contact, it is possible to gradually increase the reaction force acting on the cover when the cover moves in the closing direction in accordance with a displacement amount of the cover, and it is possible to increase the operability at the time of closing the cover. Moreover, it is possible to keep the electrical contact of the carriage unit and the electrical contact of the ink cartridge in press-contact in a stable state by the energizing force acting in parallel with the press-contact direction thereof via the insertion member.

In the invention it is preferable that a pressing-down member which touches or moves away from an upper portion of the ink cartridge in accordance with a movement of the cover in the closing direction or the opening direction is disposed on the cover, and the pressing-down member is caused to touch the upper portion of the ink cartridge when the cover is closed, whereby the ink cartridge is securely held on the carriage unit.

According to the invention, when the cover is closed after the ink cartridge is mounted on the carriage unit, the pressing-down member touches the upper portion of the ink cartridge, and presses the ink cartridge downward. Therefore, a secure state of the ink cartridge on the carriage unit is held in a stable manner.

According to the invention, by causing the pressing-down member to touch the upper portion of the ink cartridge and pressing the ink cartridge downward when the cover is closed after the ink cartridge is mounted on the carriage unit, it is possible to hold a secure state of the ink cartridge on the carriage unit in a stable manner.

In the invention it is preferable that a tip end of the insertion member is formed like a wedge.

According to the invention, in accordance with a movement of the cover in the closing direction, between the energizing means and the wall face on the opposite of the ink cartridge, the insertion member with the tip end formed like a wedge is inserted in. Therefore, a component force in the insertion direction of the energizing force acting on the insertion member from the energizing means as a reaction force of a closing movement of the cover becomes small enough, and the operability at the time of closing the cover further increases.

According to the invention, by inserting the insertion member with the tip end formed like a wedge in between the energizing means and the wall face on the opposite side to the wall face provided with the electrical contact of the ink cartridge in accordance with a movement of the cover in the closing direction, it is possible to make a component force in the insertion direction of the energizing force acting on the insertion member from the energizing means as a reaction force of a closing movement of the cover small enough, and it is possible to further increase the operability at the time of closing the cover.

In the invention it is preferable that the pressing-down member is connected to the insertion member via an elastic member.

According to the invention, when the cover is closed after the ink cartridge is mounted on the carriage unit, the pressing-down member connected to the insertion member via the elastic member touches the upper portion of the ink cartridge. Therefore, the pressing-down member elastically touches the upper portion of the ink cartridge and presses the ink cartridge by the elasticity of the elastic member, and a secure state of the ink cartridge on the carriage unit is maintained in a stable manner.

According to the invention, by causing the pressing-down member connected to the insertion member via the elastic member to touch the upper portion of the ink cartridge when the cover is closed after the ink cartridge is mounted on the carriage unit, it is possible to cause the pressing-down member to elastically touch the upper portion of the ink cartridge and continue pressing the ink cartridge by the elasticity of the elastic member, and it is possible to maintain a secure state of the ink cartridge on the carriage unit in a stable manner.

In the invention it is preferable that a plurality of ink cartridges are mounted on the carriage unit so as to be attachable and detachable, and the cover is formed integrally with all of the ink cartridges mounted on the carriage unit.

According to the invention, all of the attachment/detachment directions of the ink cartridges mounted on the carriage unit are opened and closed by a single cover. Therefore, a closing operation of the cover at the time of mounting the ink cartridges on the carriage unit is completed at one time. Moreover, supporting members to be provided between covers, respectively, in the case of disposing the covers to the individual ink cartridges are not necessary, spaces between the ink cartridges are decreased, and the carriage is downsized.

According to the invention, by opening and closing all of the attachment/detachment directions of the ink cartridges mounted on the carriage unit by the single cover, it is possible to complete a closing operation of the cover at the time of mounting the ink cartridges on the carriage unit at one time, whereby the operability increases. Moreover, it is possible to eliminate the need for supporting members to be provided between covers, respectively, in the case of disposing the covers on the individual ink cartridges, and it is possible to decrease spaces between the ink cartridges and downsize the carriage.

In the invention it is preferable that instead of the ink cartridge, a nozzle cartridge having an electrical contact and an ink bottle are mounted on the carriage unit so as to be attachable and detachable.

According to the invention, by inserting the nozzle cartridge in which the ink bottle is fitted into the carriage unit, and closing and latching the cover, the ink bottle and the nozzle cartridge are securely held on the carriage unit, and the electrical contact disposed on the nozzle cartridge is energized and kept in press-contact by the energizing means in a direction opposed to the electrical contact disposed on the carriage unit, with the result that it is possible to conduct a mounting operation of the ink bottle and the nozzle cartridge with operability, and obtain a stable conduction state.

According to the invention, by inserting the nozzle cartridge in which the ink bottle is fitted into the carriage unit, and closing and latching the cover, the ink bottle and the nozzle cartridge are securely held on the carriage unit, and the electrical contact disposed on the nozzle cartridge is energized and kept in press-contact by the energizing means in a direction opposed to the electrical contact disposed on the carriage unit, with the result that it is possible to increase the operability of a mounting operation of the ink bottle and the nozzle cartridge, and obtain a stable conduction state.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
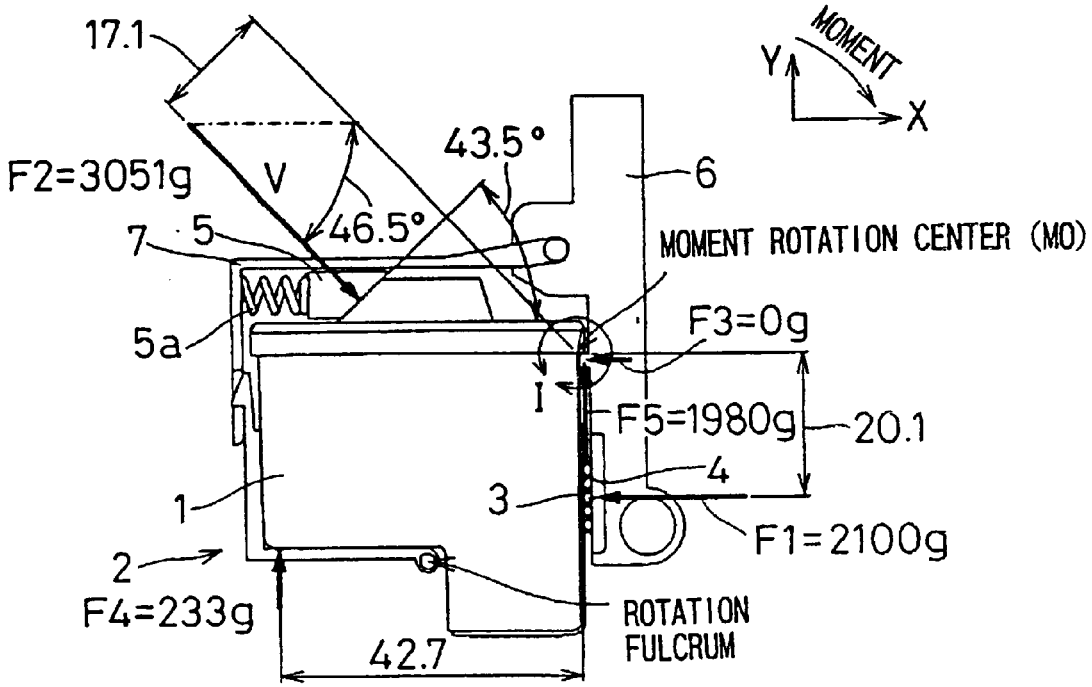
FIG. 1A PRIOR ART
FIGS. 1A to 1C are views showing an example of a conventional carriage unit.

Now referring to the drawings, preferred embodiments of the invention are described below.

A recording apparatus relating to an embodiment of the present invention will be described in detail below referring to the drawings.

Figure 3A:
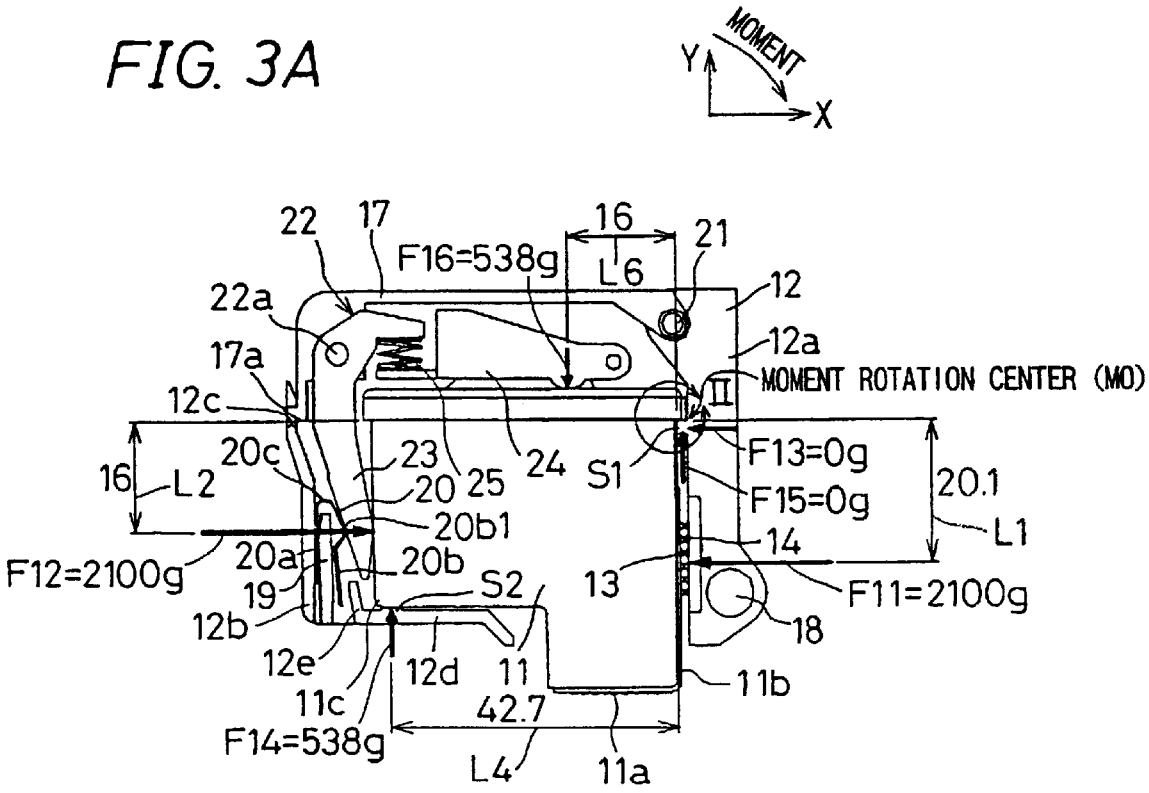
FIGS. 3A and 3B are sectional views showing substantial parts of a recording apparatus relating to an embodiment of the present invention.
Figure 3B:
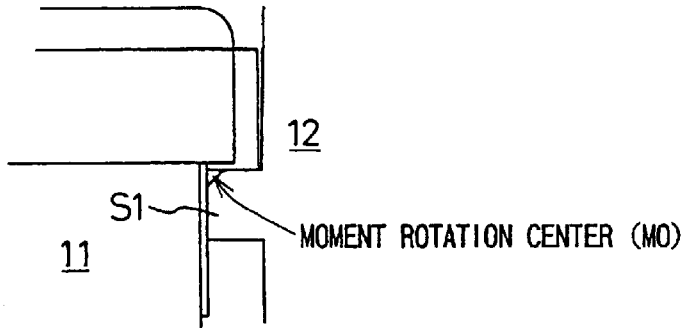
Figure 4:
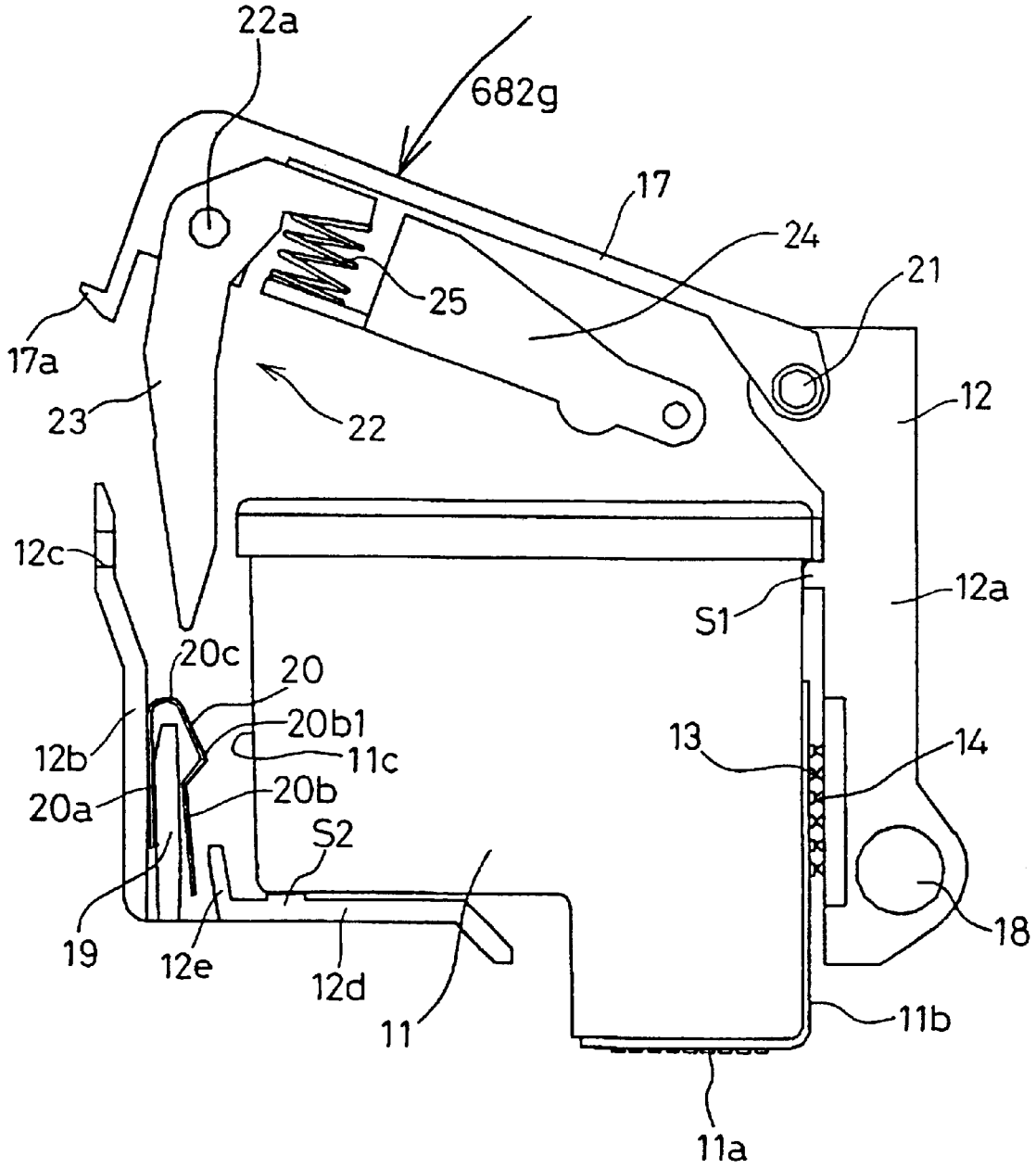
FIG. 4 is a sectional view of a carriage unit in a state where a cover is opened.

FIG. 3A is a sectional view showing a state where an ink cartridge 11 is mounted on a carriage unit 12, and FIG. 3B is an enlarged sectional view showing a section II of FIG. 3A. FIG. 4 is a sectional view showing the carriage unit 12 in a state where a cover is opened. This ink cartridge 11 is an ink cartridge integral with an ink bottle, and provided with an ink nozzle 11*a* at a lower portion thereof and an electrical contact 13 on one side face thereof. Between the ink nozzle 11*a* and the electrical contact 13, a flexible print board 11*b* is disposed.

On the other hand, the carriage unit 12 holds the ink cartridge 11 so as to be attachable and detachable. On one side wall 12*a* of the carriage unit 12, an electrical contact 14 conduction-connected to the electrical contact 13 of the ink cartridge 11 is disposed. Moreover, at a lower portion of the other side wall 12*b* opposed to the one side wall 12*a* of the carriage unit 12, a spring reception part 19 is protruded upwardly. To the spring reception part 19, a spring-like member 20 made up by a leaf spring serving as energizing means is fitted with a sharp-pointed portion 20*b*1 thereof directed inwardly. More specifically, the spring-like member 20 has a sectional shape formed into substantially U-shape, and includes a first stretched portion 20*a* which extends almost straight, a second stretched portion 20*b* which has the sharp-pointed portion 20*b*1 bent and formed so as to protrude in a direction away from the first stretched portion 20*a*, and a curved joining portion 20*c* which curves and joins the first and second stretched portions 20*a* and 20*b*. The spring-like member 20 is fitted to the spring reception part 19 with the sharp-pointed portion 20*b*1 directed toward the one side wall 12*a* so that the first stretched portion 20*a* is fitted in between the other side wall 12*b* and the spring reception part 19. When a front wedge 23 described later does not touch the spring-like member 20, that is, when a free end of the second stretched portion 20*b* exists in a free position, the free end locates in the vicinity of the spring reception part 19 and touches a protruding piece 12*e* protruded from a bottom portion 12*d* of the carriage unit 12. To an upper portion of the one side wall 12*a* of this carriage unit 12, a base of a cover 17, which is a cover having a substantially L-shaped section and covering the ink cartridge 11, is mounted by a supporting axis 21 so as to be rotatable. To a tip end of the cover 17, the front wedge 23 serving as an insertion member is attached by a pin axis 22*a* so as to be rotatable. More specifically, the front wedge 23 is movable in a press-contact direction of the electrical contact 14 of the carriage unit 12 and the electrical contact 13 of the ink cartridge 11. Moreover, a pressing member 22 includes the front wedge 23 with the tip end formed like a wedge and a pressing-down member 24 attached to the cover 17 so as to be rotatable and capable of pressing the ink cartridge 11 downward.

The front wedge 23 is inserted in between the spring-like member 20 and the wall face 11*c* on the opposite side to the wall face provided with the electrical contact 13 of the ink cartridge 11 when the cover 17 is closed, thereby flexibly deforming the spring-like member 20 and causing the energizing force to act on the ink cartridge 11. At this moment, the free end of the second stretched portion 20*b* of the spring-like member 20 is moved away from the protruding portion 12*e*, and placed in a load position. As a result, the electrical contact 13 is energized to the electrical contact 14 of the carriage unit 12 in a press-contact state, and both the contacts 13 and 14 are kept in a stable conduction state. When the cover 17 is opened, the front wedge 23 is removed from between the spring-like member 20 and the wall face 11*c* on the opposite side.

Further, the pressing-down member 24 is elastically connected to the front wedge 23 via an elastic member 25 made up by a helical compression spring. The pressing-down member 24 touches the upper face of the ink cartridge 11 and presses down to secure the ink cartridge 11 in a main body of the carriage unit 12 when the cover 17 is closed, whereas moves away from the upper face of the ink cartridge 11 when the cover 17 is opened. As a result, the ink cartridge 11 becomes removable.

At a tip end of the cover 17 bent downward on the opening/closing end side, a latch hook 17*a* which is latched so as to be latched and removed onto a rim portion defining a reception hole 12*c* formed at an upper portion of the other side wall 12*b* of the carriage unit 12 is formed. When the cover 17 is closed, as shown in FIG. 3A, the latch hook 17*a* is passed through the reception hole 12*c* and engaged with the rim portion of the reception hole 12*c*, and the latch hook 17*a* enters a cover-closed state (a latched state). In order to open the cover 17, an operation piece (not shown in the drawings) disposed in the vicinity of the reception hole 12*c* outward separately is operated, and the latched state is released.

Thus, the front wedge 23 is inserted in between the spring-like member 20 and the wall face 11*c* of the ink cartridge 11 when the cover 17 is closed and the cover 17 is latched to the carriage unit 12, whereby the electrical contact 13 of the ink cartridge 11 is efficiently energized and kept in press-contact in a direction opposed to the electrical contact 14 of the carriage unit 12, and a stable conduction state can be obtained.

At the time, the pressing-down member 24 connected to the front wedge 23 touches the upper face of the ink cartridge 11, and presses to hold the ink cartridge 11 on the bottom portion of the carriage unit 12. A state of touching the upper face of the ink cartridge 11 can be soft because the pressing-down member 24 is connected to the front wedge 23 via the elastic member 25, and the securing state is stabilized because the ink cartridge 11 is energized to the carriage unit 12 in an elastic state.

Further, although the pressing-down member 24 is elastically connected to the front wedge 23 via the elastic member 25 in the embodiment, the elastic members 25 may be disposed individually between the front wedge 23 and the cover 17 and between the pressing-down member 24 and the cover 17, or the pressing-down member 24 may be formed by attaching a resin spring, a coil spring, a leaf spring, a tension spring, an elastic body such as rubber, polymer or urethane rubber, or the like to the cover 17.

Since the aforementioned front wedge 23 is attached to the cover 17 so as to be rotatable and the tip end thereof is formed like a sharp-pointed wedge as described before, it is possible to surely insert it in between the spring-like member 20 and the wall face 11*b* of the ink cartridge 11 in an almost perpendicular state from upward when the cover 17 is closed. Moreover, since the front wedge easily moves away from between the spring-like member 20 and the wall face 11*c* and a space is formed between the wall face 11*c* of the ink cartridge 11 and the spring-like member 20 when the cover 17 is opened as shown in FIG. 4, it is possible to easily take the ink cartridge 11 out of the carriage unit 12 without resistance.

Figure 5B:
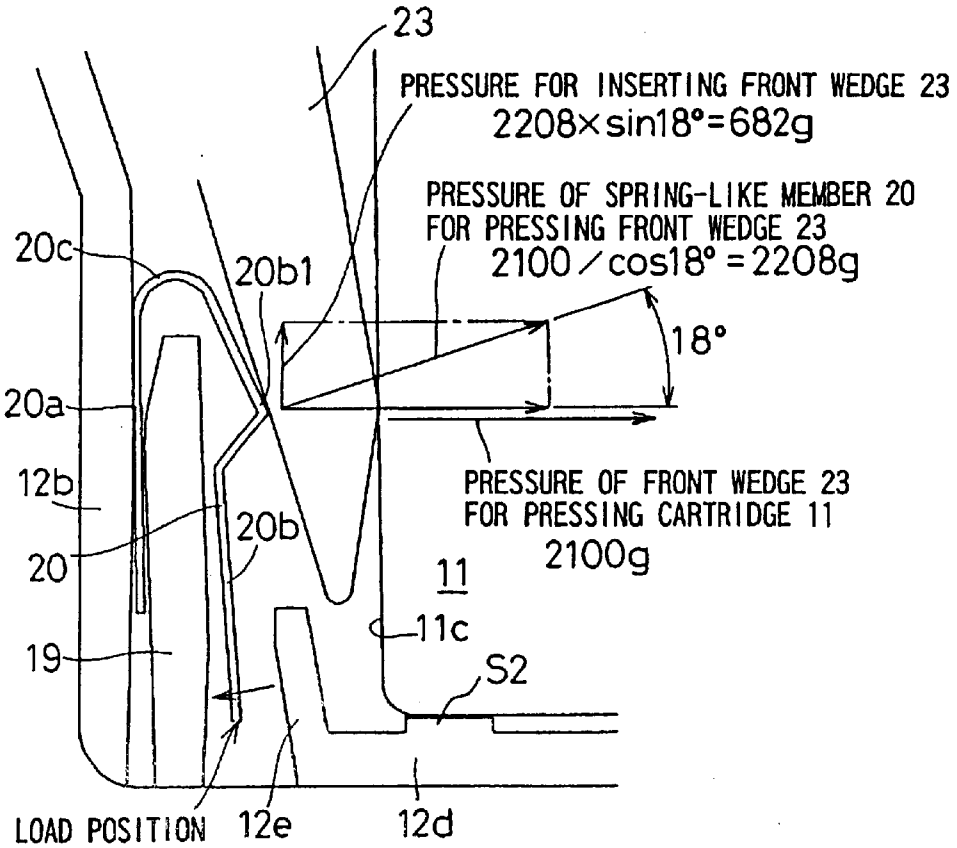
FIGS. 5A and 5B are views for explaining a pressure which acts on the ink cartridge.
Figure 5A:
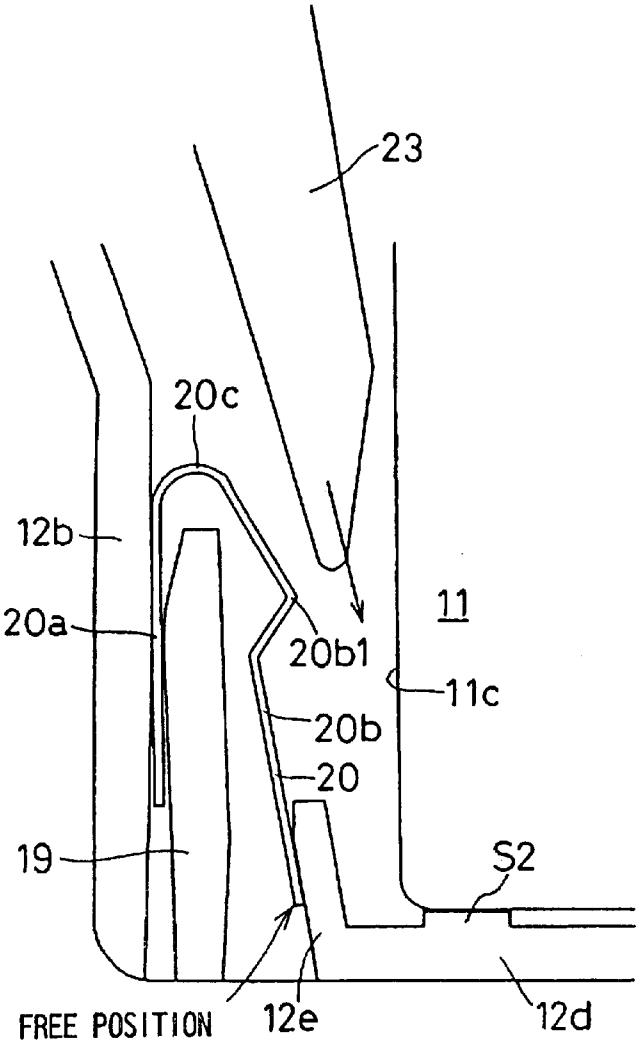

FIGS. 5A and 5B are views for explaining a pressure acting on the ink cartridge 11. More specifically, as shown in FIGS. 5A and 5B, when the cover 17 is closed and the front wedge 23 is inserted in between the wall face 11*c* of the ink cartridge 11 and the spring-like member 20, the wall face 11*c* undergoes a pressure from the spring-like member 20 via the front wedge 23 in a direction inclined 18° upward with respect to the horizontal direction. Therefore, the electrical contact 13 of the ink cartridge 11 is pressed to the electrical contact 14 of the carriage unit 12 by a horizontal component force of the energizing force of the spring-like member 20 of a tilt angle 18°.

Regarding the recording apparatus constructed in the above manner, as shown in FIG. 3A, an example of a calculation result of actually substituting appropriate values will be shown below.

Here, F11 is a pressure required at the very least so as to be electrically conducted between the electrical contacts 13 and 14.

F12 is a force that the front wedge 23 pressurizes the ink cartridge 11 from the opposite side to F11, that is, the opposite side to the electrical contact 13.

F13 is a force which acts on a stopper s1 protruded toward the other side wall 12*b* at the upper portion of the one side wall 12*a* of the carriage unit 12 when the ink cartridge 11 is pressurized by F12 rightward in the horizontal direction.

F14 is a force which acts on a stopper s2 disposed on the bottom portion 12*d* of the carriage unit 12 when the ink cartridge 11 is pressurized by F16 downward in the perpendicular direction.

F15 is a force which acts on the stopper s1 of the carriage unit 12 when the ink cartridge 11 is pressurized by F16 downward in the perpendicular direction.

F16 is a force for holding the ink cartridge 11 on the carriage unit 12 in the perpendicular direction (vertical direction).

The above forces exerted on the cartridge ii are decomposed to X, Y and moment to examine.

$$X \text{ direction: } F12-F11-F13=0 \quad (4)$$

$$Y \text{ direction: } F14+F15-F16=0 \quad (5)$$

$$\text{Moment: } L1\times F11+L4\times F4-L2\times F12-L6\times F16=0 \quad (6)$$

A rotation center of the moment is denoted by MO in the drawing.

Here:

L1 is a perpendicular distance from the moment rotation center to an acting point of F11;

L2 is a perpendicular distance from the moment rotation center to an acting point of F12;

L4 is a horizontal distance from the moment rotation center to an acting point of F14; and L6 is a horizontal distance from the moment rotation center to an acting point of F16.

On this occasion, when F11 is set to a pressure as much as necessary for conduction between the electrical contacts 13 and 14, and F12 to F16, and L1, L2, L4 and L6 are set so as to have appropriate values, the ink cartridge 11 is securely held on the carriage unit 12 in a stable state.

For example, assuming that a pressure F11 required to obtain electrical conduction between the electrical contacts 13, 14 is 2100 g:

in a case where L1=20.1, L2=16, L4=42.7 and L6=16, $$X \text{ direction: } F12-F11-F13=0 \quad (4)$$

$$Y \text{ direction: } F14+F15-F16=0 \quad (5)$$

$$\text{Moment: } 20.1 \cdot F11+42.7 \cdot F14-16 \cdot F12-16 \cdot F16=0 \quad (6)$$

In the case of calculating so that F11 to F16 have positive values in the respective expressions (4), (5) and (6) described above, the minimum values of F11 to F16 are the following values:

F11=2100 g, F12=2100 g, F13=0 g, F14=0 g, F15=538 g, and F16=538 g.

As in the prior art, it is desirable that F13, F14 have values of 0 or more, so that F12, F15 and F16 have values of the above or more.

Therefore, in a case where the pressure F11 necessary for obtaining electrical conduction is 2100 g as in the prior art, a pressure required to the spring-like member 20 is 2100/cos 18°=2208 g as shown in FIG. 5B, so that a lower value than 3051 g in the prior art is sufficient.

On the other hand, at the time of closing the cover 17, it is possible by a perpendicular component force of 2208 g, that is, 2208×sin 18°=682 g, which is a considerably smaller force than 2213 g in the prior art, to close the cover 17, and the operability increases.

In the case of mounting a plurality of ink cartridges 11 on the carriage unit 12 in the recording apparatus constructed in the above manner (for example, in the case of a color recording apparatus), which is not shown in the drawings, in a construction of using a single cover 17 (in common) and attaching a plurality of pressing members 22 corresponding to the respective ink cartridges 11 to the cover 17, it is possible to reduce parts count.

Figure 6B:
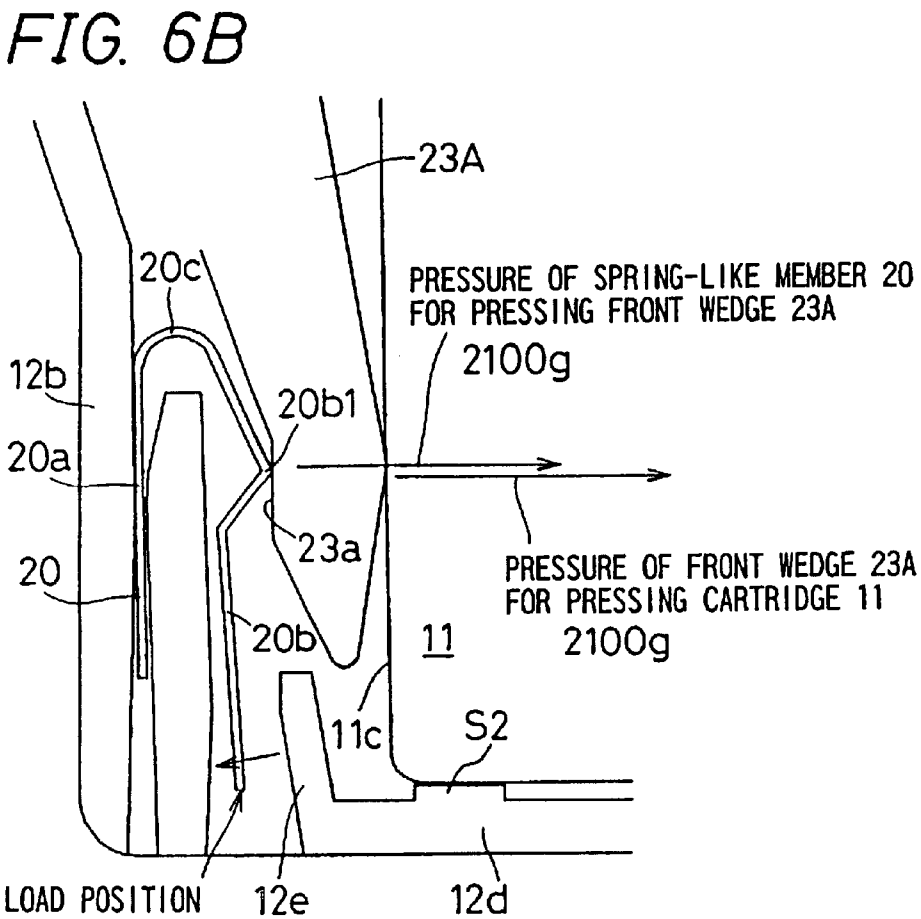
FIGS. 6A and 6B are views showing a modified example of a front wedge.
Figure 6A:
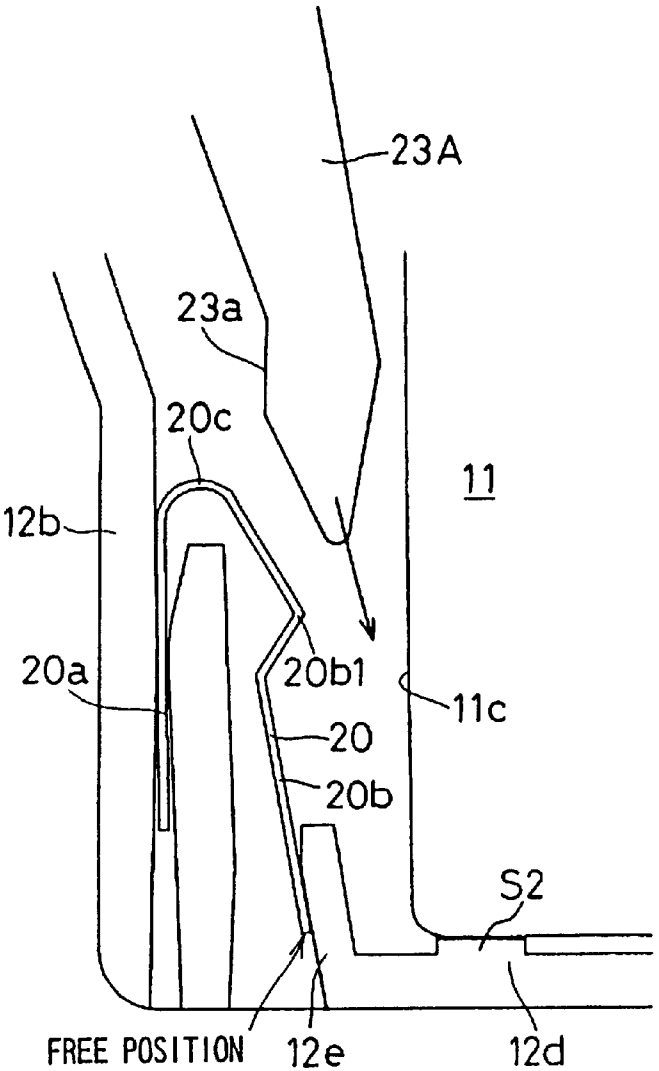

FIGS. 6A and 6B show a modified example of a front wedge. In this case, a touching face 23*a* of a front wedge 23A on the side of touching the spring-like member 20 is formed vertical shape so that an energizing force of the spring-like member 20 perpendicularly acts on the wall face 11*c* of the ink cartridge 11. More specifically, the touching face 23*a* of the front wedge 23A on the side of touching the sharp-pointed portion 20*b*1 of the spring-like member 20 is formed so as to become parallel with the wall face 11*c* of the ink cartridge 11 at the time of touching the sharp-pointed portion 20*b*1. With such a shape, a pressure necessary for obtaining stable electrical conduction between the electrical contacts 13 and 14 is only 2100 g (less than in the case shown in FIG. 5B by about 5%), and therefore, an energizing force (an elastic force) required to the spring-like member 20 is further small. As a matter of course, the perpendicular component force (682 g) generated in the case shown in FIG. 5B does not exist, with the result that an opening/closing operation of the cover 17 becomes easy, and it is possible to realize reduction of the cost and reduction of the weight to downsize.

Figure 7B:
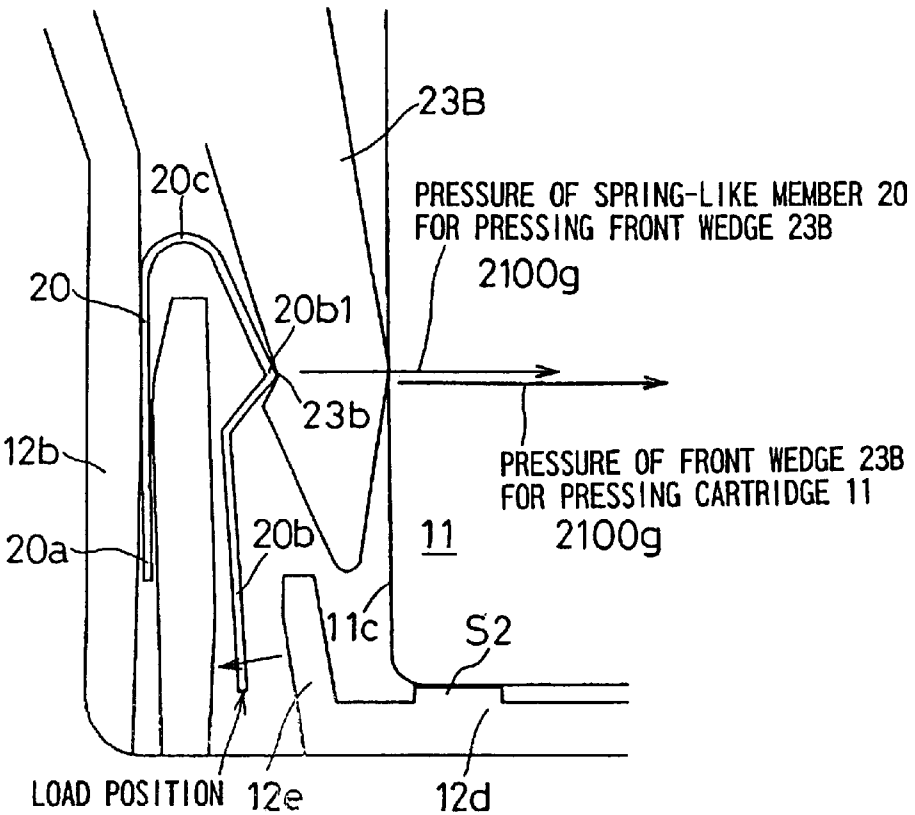
FIGS. 7A and 7B are views showing another modified example of a front wedge.
Figure 7A:
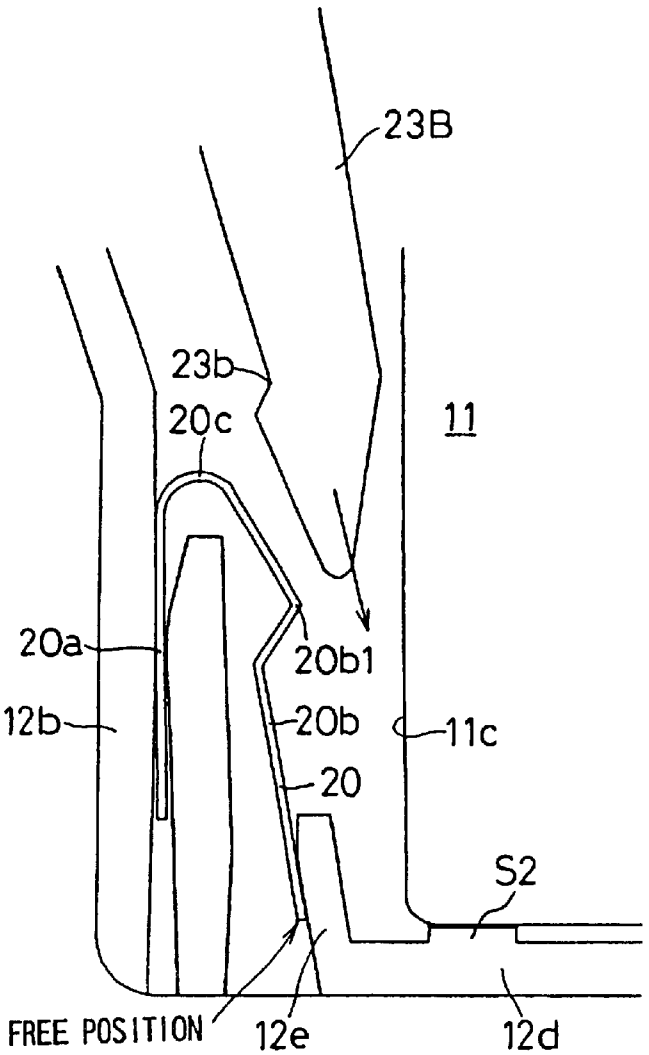

FIGS. 7A and 7B show another modified example of a front wedge, and in this case, a part of a front wedge 23B touching the spring-like member 20 is formed like a concave. Thus, it is possible when the cover 17 is closed to surely fit the sharp-pointed portion 20*b*1 of the spring-like member 20 into a concave portion 23*b* of the front wedge 23B and cause an energizing force of the spring-like member 20 to further surely act on the wall face 11*c* of the ink cartridge 11 via the front wedge 23B.

At this moment, the energizing force of the spring-like member 20 is exerted on the front wedge 23B in the horizontal direction as in the case of FIG. 6B, so that a stable electric conduction between the electrical contacts 13 and 14 can be obtained by applying a pressure of 2100 g as in the case of FIG. 6B. Therefore, it is possible to further increase the stability of the operability at the time of mounting the ink cartridge 11.

Although this spring-like member 20 can be formed by, for example, bend-processing a metal leaf spring as shown in FIGS. 5A to 7B, an elastic resin material, a tension spring, a coil spring, elastic rubber or urethane rubber may be used, or the pressing member 5 energized by the coil spring 5*a* shown in FIG. 1 may be disposed, or these may be used in combination as necessary. Or, this spring-like member 20 may be disposed on the front wedge 23, 23A and 23B.

In short, the spring-like member 20 is disposed so that the electrical contact 13 of the ink cartridge 11 can cause an energizing force to act in a direction opposed to the electrical contact 14 of the carriage unit 12, and an attachment position, a shape, a construction or the like thereof may be selected and set as necessary.

Figure 8:
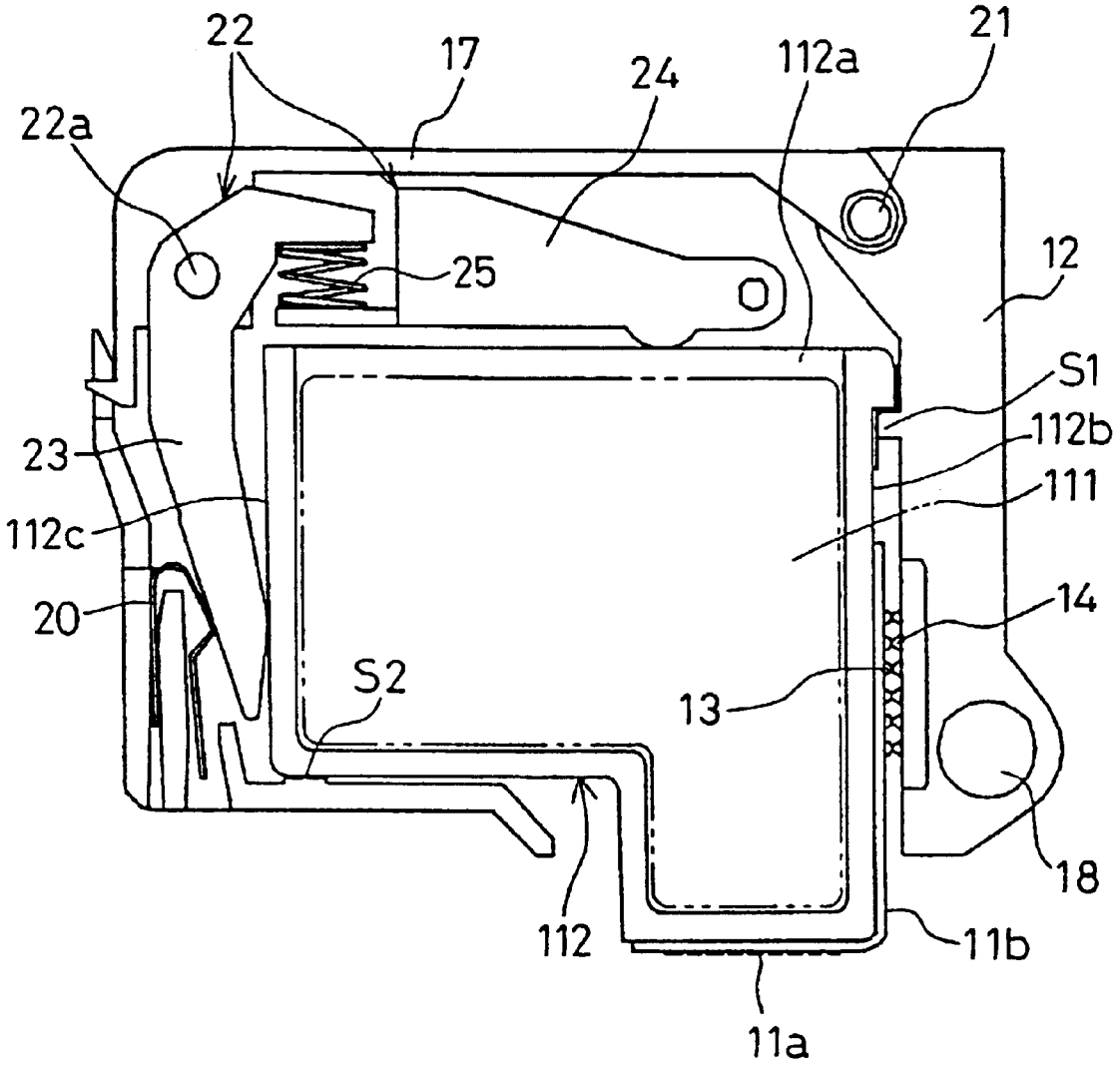
FIG. 8 is a sectional view showing substantial parts of a recording apparatus relating to another embodiment of the invention.

FIG. 8 is a sectional view showing substantial parts of a recording apparatus relating to another embodiment of the invention. In the embodiment, instead of the integral-type ink cartridge 11, a nozzle cartridge 112 in which an ink bottle 111 is fitted and contained is mounted on the carriage unit 12. Therefore, the electrical contact 13 thereof is disposed on one side face 112*b* of the nozzle cartridge 112, and the front wedge 23 is inserted in between the spring-like member 20 and the other side face 112*c* of the nozzle cartridge 112. On the other hand, the pressing-down portion 24 touches an upper portion of a longitudinal wall 112*a* of the nozzle cartridge 112, and when pressed down, securely holds the nozzle cartridge 112 with the ink bottle 111 in the carriage unit 12.

Also in this case, in the nozzle cartridge 112, a single ink bottle 111 may be mounted, or a plurality of ink bottles may be mounted. In the case of mounting a plurality of ink bottles 111 in the nozzle cartridge 112, parts count may be reduced by constructing a single cover 17 so as to be common for the ink bottles and attaching a plurality of pressing members 22 corresponding to the respective ink bottles 111 to the cover 17.

Figure 9B:
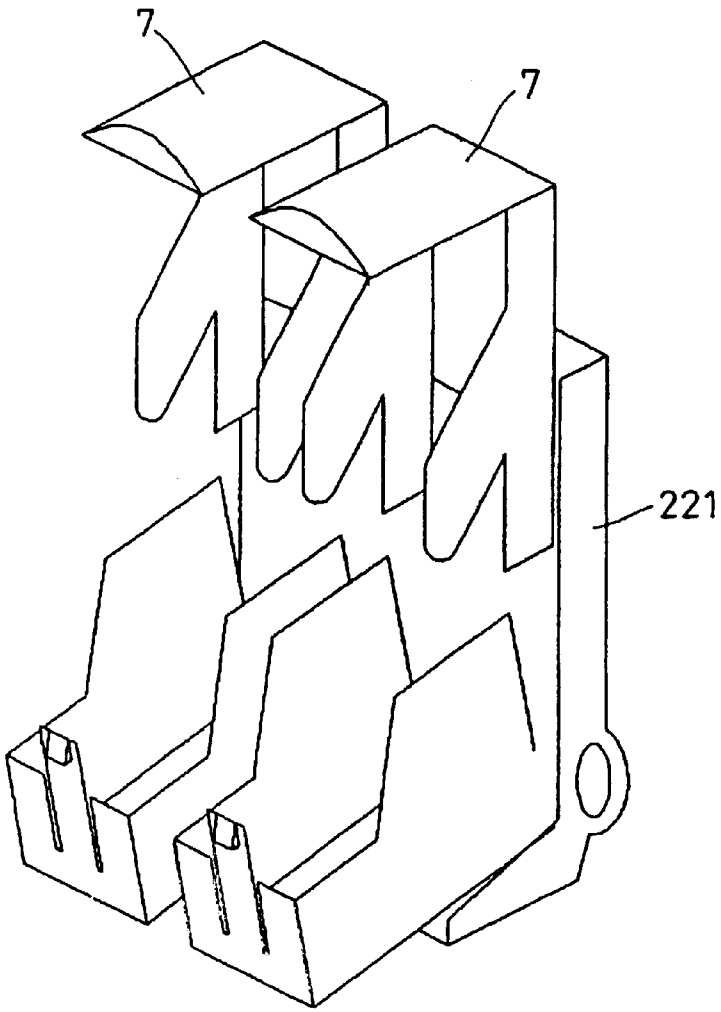
FIG. 9B PRIOR ART
FIGS. 9A and 9B are perspective views showing a carriage unit of a recording apparatus relating to still another embodiment of the present invention in comparison with the prior art.
Figure 9A:
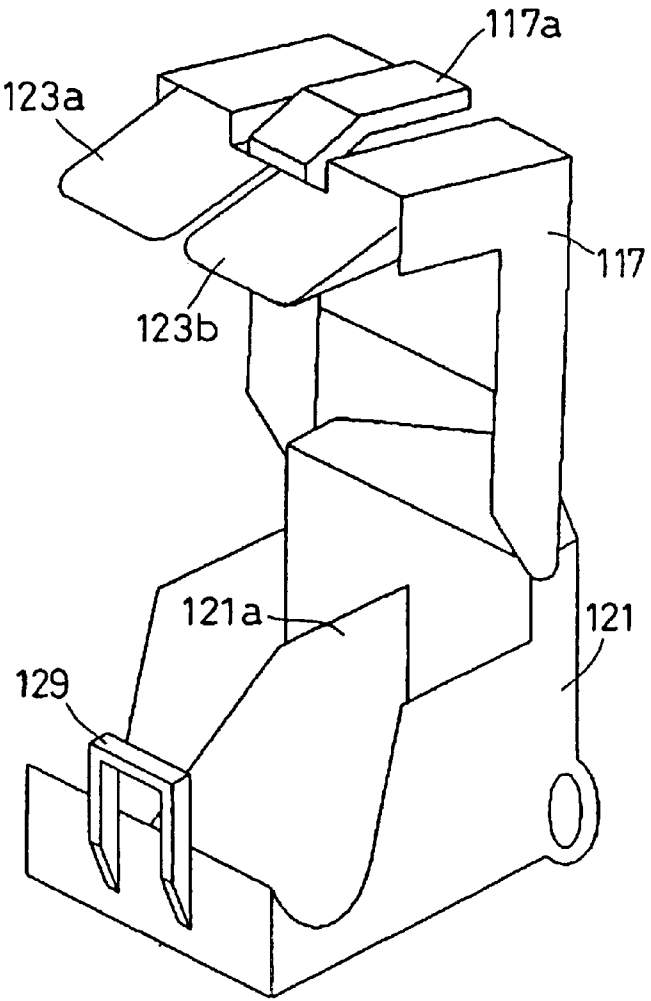

FIGS. 9A and 9B are perspective views showing, in comparison with the prior art, a carriage unit used in a recording apparatus relating to still another embodiment of the invention. A carriage unit 121 used in the recording apparatus relating to the embodiment, as shown in FIG. 9A, allows mounting two ink cartridges 11. For example, one of the two ink cartridges 11 contains black ink, and the other contains color ink. The carriage unit 121 is provided with two mounting parts for the ink cartridges 11 constructed as shown in FIGS. 3A, 3B and 4 aligned in a main scanning direction. In other words, the respective mounting portions of the two ink cartridges 11 in the carriage unit 121 are provided with the spring-like members 20 fitted to the spring reception parts 19 individually, and provided with the electrical contacts 14 (not shown in the drawings) to be electrically conducted to the electrical contacts 13 of the ink cartridges 11 individually. Moreover, in the middle of a front face of the carriage unit 121 in the main scanning direction, a single latching member 129 is formed.

To this carriage unit 121, a single cover 117 provided with two front wedges 123*a* and 123*b* together with two pressing members (not shown in the drawings) is supported so as to be rotatable. The cover 117 is opposed to a full width of the carriage unit 121 in the main scanning direction, and opens and closes mounting directions of both the two ink cartridges 11 on the carriage unit 121 at a time. That is to say, the cover 117 is made up by integrating the two covers 17 securely holding the respective two ink cartridges 11. In the middle of a front face of the cover 117 in the main scanning direction, a single latching piece 117*a* is formed. The cover 117 is kept in a closed state only by engagement of a pair of the latching piece 117*a* and the latching member 129.

In the above construction, by closing the single cover 117 after mounting the two ink cartridges 11 on the carriage unit 121, the two ink cartridges 11 are securely held on the carriage unit 121 in a state where the respective electrical contacts 13 are kept in press-contact to the electrical contact 14 of the carriage unit 121. Although, at the time of closing the cover 117, energizing forces of the two spring-like members 20 act as reaction forces mainly, the reaction forces acting from the respective spring-like members 20 are small enough as shown in FIGS. 3A to 5B, and gradually increase as the cover 117 is closed. Therefore, even when the cover of the invention for securely holding the two ink cartridges 11 is constructed as the cover 117 in one piece, the operability at the time of closing the cover 117 does not decrease significantly.

Figure 1B:
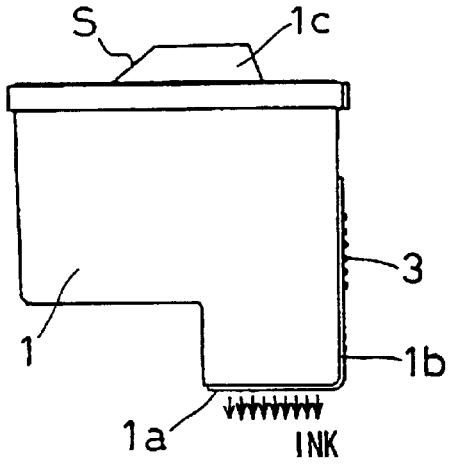
FIG. 1B PRIOR ART
Figure 1C:
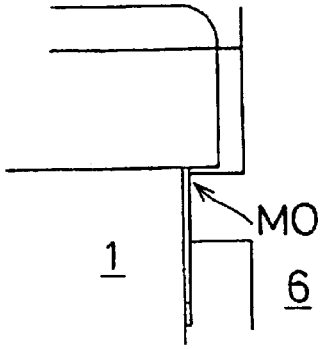
FIG. 1C PRIOR ART
Figure 2:
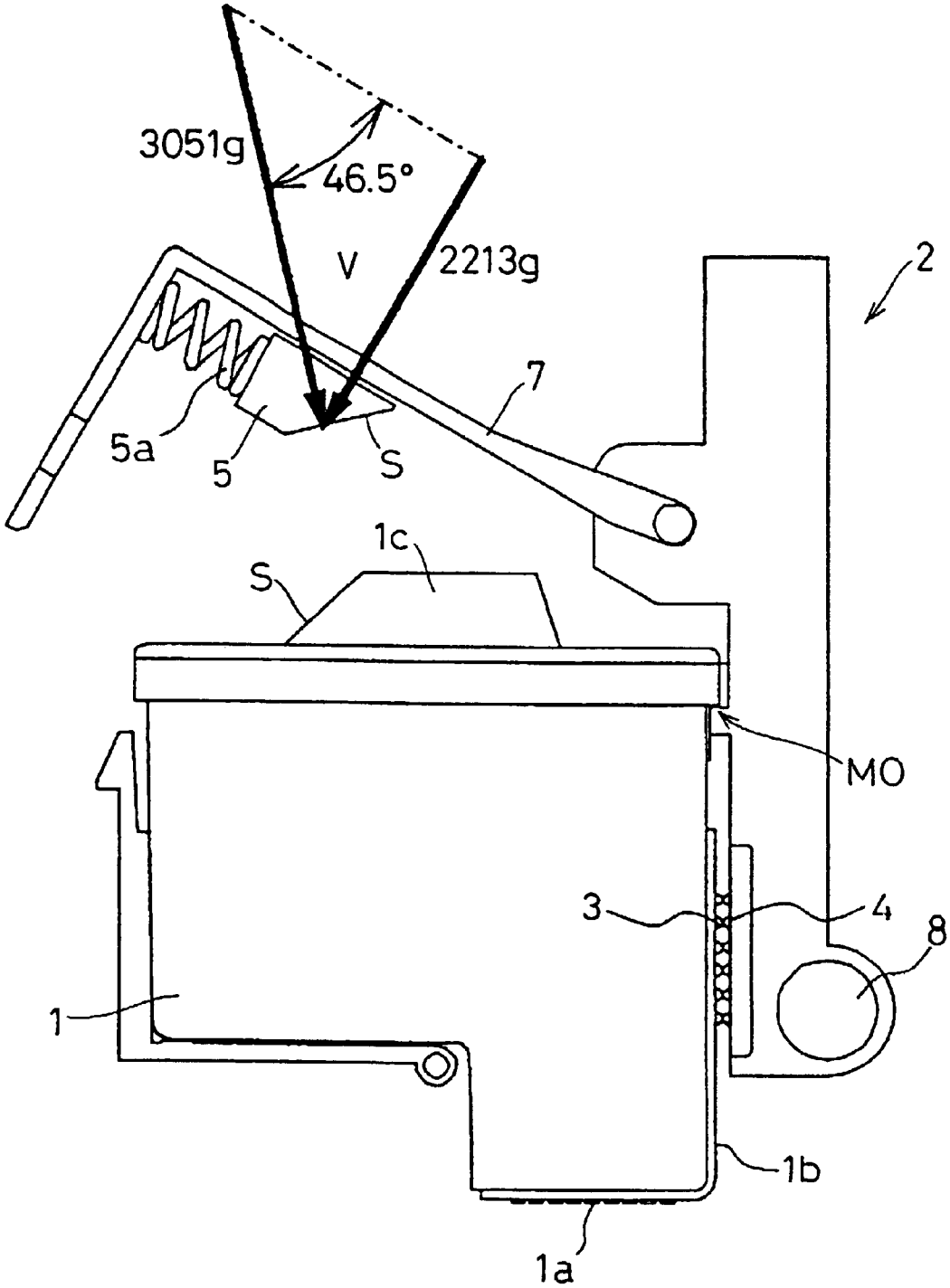
FIG. 2 PRIOR ART
FIG. 2 is a sectional view of the conventional carriage unit in a state where a cover is opened.

On the other hand, in a carriage unit 221 used in the conventional recording apparatus shown in FIG. 9B, each of the two ink cartridges 11 to be mounted is provided with one cover 7. This is because, as shown in FIGS. 1A to 1C, a reaction force at the time of closing the one cover 7 is large enough, and therefore, the operability at the time of closing decreases significantly in the case of constructing the two covers 7 in one piece. Thus, the conventional carriage unit 221 needs to support the two covers 7 individually so as to be openable and closable, and needs to have a space for placing a supporting member between the covers 7 in the main scanning direction. Therefore, it is necessary to ensure a specified space between containing parts of the two ink cartridges 11 in the carriage unit 221, and a full width of the carriage unit 221 in the main scanning direction gets larger than the width for the two ink cartridges 11.

In this respect, in the carriage unit 121 used in the recording apparatus relating to the embodiment of the invention, only the single cover 117 is supported, and there is no need to ensure a space for placing a supporting portion of the cover between the containing parts of the two ink cartridges 11, so that it is possible to cause the full width of the carriage unit 121 in the main scanning direction to be substantially the same as the width for the two ink cartridges 11, and it is possible to downsize the apparatus. In the example shown in FIG. 9A, for the purpose of defining mounting positions, a thin partition wall 121*a* is disposed between the mounting portions of the respective ink cartridges 11. Moreover, an operation for securely holding the two ink cartridges 11 on the carriage unit 121 is completed at one time, and the operability increases.

Although the carriage unit 121 where the two ink cartridges 11 are mounted at a time is explained in the example shown in FIG. 9A, the invention can be implemented also in a carriage unit where three or more ink cartridges 11 are mounted at a time. As the number of ink cartridges mounted at a time increases, increase of the operability owing to decrease of operations and an effect of downsizing the apparatus owing to reduction of the full width of the carriage unit in the main scanning direction become remarkable.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A recording apparatus comprising:

a carriage unit having an electrical contact;

an ink cartridge having an electrical contact, the ink cartridge being mounted so as to be attachable and detachable to the carriage unit in a state where the electrical contacts are kept in press-contact with each other;

a cover for opening and closing an attachment/detachment direction of the ink cartridge in the carriage unit;

energizing means for generating an energizing force responsive to a deformation amount in the opposite direction to a deformation direction, the energizing means being arranged in the carriage unit so as to be opposed to a wall face on the opposite side to a wall face provided with the electrical contact of the ink cartridge mounted on the carriage unit; and an insertion member which is inserted in or removed from between the energizing means and the wall face on the opposite side to the wall face provided with the electrical contact of the ink cartridge in accordance with a movement of the cover in a closing direction or an opening direction, the insertion member being disposed on the cover so as to be movable in a press-contact direction of the electrical contact of the carriage unit and the electrical contact of the ink cartridge, wherein the insertion member deforms the energizing means in accordance with a movement of the insertion member in an insertion direction so as to gradually move away from the wall face on the opposite side to the wall face provided with the electrical contact of the ink cartridge in the opposite direction to the press-contact direction.

2. The recording apparatus of claim 1, wherein a pressing-down member which touches or moves away from an upper portion of the ink cartridge in accordance with a movement of the cover in the closing direction or the opening direction is disposed on the cover, and the pressing-down member is caused to touch the upper portion of the ink cartridge when the cover is closed, whereby the ink cartridge is securely held on the carriage unit.

3. The recording apparatus of claim 2, wherein a tip end of the insertion member is formed like a wedge.

4. The recording apparatus of claim 2, wherein the pressing-down member is connected to the insertion member via an elastic member.

5. The recording apparatus of claim 1, wherein a plurality of ink cartridges are mounted on the carriage unit so as to be attachable and detachable, and the cover is formed integrally with all of the ink cartridges mounted on the carriage unit.

6. The recording apparatus of claim 1, wherein instead of the ink cartridge, a nozzle cartridge having an electrical contact and an ink bottle are mounted on the carriage unit so as to be attachable and detachable.

* * * * *